US010085563B2

(12) United States Patent
Qi et al.

(10) Patent No.: US 10,085,563 B2
(45) Date of Patent: Oct. 2, 2018

(54) CHAIR CAPABLE OF SWINGING FORWARD AND BACKWARD

(71) Applicant: Qianglong Furniture Co., Ltd., Huzhou, Zhejiang (CN)

(72) Inventors: Zhiqiang Qi, Zhejiang (CN); Yong Chern Ng, Zhejiang (CN)

(73) Assignee: Qianglong Furniture Co., Ltd., Huzhou (CN)

( * ) Notice: Subject to any disclaimer, the term of this patent is extended or adjusted under 35 U.S.C. 154(b) by 37 days.

(21) Appl. No.: 15/245,198

(22) Filed: Aug. 24, 2016

(65) Prior Publication Data

US 2017/0332789 A1 Nov. 23, 2017

(30) Foreign Application Priority Data

May 19, 2016 (CN) ..... 2016 2 0459471 U

(51) Int. Cl.
*A47C 1/00* (2006.01)
*A47C 3/025* (2006.01)
*A47C 3/026* (2006.01)

(52) U.S. Cl.
CPC ..... *A47C 3/0255* (2013.01); *A47C 3/026* (2013.01)

(58) Field of Classification Search
CPC ..... A47C 3/025; A47C 3/0255; A47C 3/026; A47C 3/18; A47C 9/022; A47C 7/443; A47C 7/44; A47C 7/441; A47C 9/025; A47C 7/002; A47C 7/004
USPC ..... 297/344.21, 313, 314, 310, 195.11, 297/354.11, 344.26, 344.24, 291, 344.11, 297/461
See application file for complete search history.

(56) References Cited

U.S. PATENT DOCUMENTS 4,099,697 A * 7/1978 Von Schuckmann ..... A47C 3/026 248/398
4,183,579 A * 1/1980 Gonzalez y. Rojas ..... A47C 9/025 248/171
4,400,032 A * 8/1983 dePolo ..... A47C 3/18 248/416
6,097,511 A * 8/2000 Hirasawa ..... H04N 5/23209 348/335
7,396,080 B2 * 7/2008 Suhr ..... A47C 3/026 297/313
7,478,878 B2 * 1/2009 Oettinger ..... A47C 3/029 297/271.5
9,801,472 B2 * 10/2017 Keen ..... A47C 9/025
2002/0043846 A1 * 4/2002 Brauning ..... A47C 3/026 297/314
2015/0250317 A1 * 9/2015 Glockl ..... A47C 9/002 297/344.12
2017/0332784 A1 * 11/2017 Huang ..... A47B 83/02

* cited by examiner

*Primary Examiner* — Chi Q Nguyen

(57) ABSTRACT

The present application discloses a chair capable of swinging forward and backward, including a chair leg, a seat cushion, and a compression air rod that connects the chair leg and the seat cushion, where a bottom of the compression air rod is provided with a tapered sleeve, the tapered sleeve is disposed inside a cavity of the chair leg, an outer side of the tapered sleeve is enclosed by a soft sleeve, and the compression air rod swings by means of an interaction between the soft sleeve and a cavity wall of the chair leg.

4 Claims, 6 Drawing Sheets

CHAIR CAPABLE OF SWINGING FORWARD AND BACKWARD

CROSS-REFERENCE TO PRIOR APPLICATION

This application claims the benefit of Chinese Utility Model Application No. 201620459471.3 filed on May 19, 2016, the contents of which are incorporated herein by reference.

BACKGROUND

Technical Field

The present application relates to a chair capable of swinging forward and backward.

Related Art

A chair is one of the favorite seats of people and is widely used at home, in offices, and in business halls.

Among chairs in the prior art, there is a chair including a base, a seat cushion, and a compression air rod that connects the base and the seat cushion, where the base is rigidly connected to the compression air rod, and a height of the seat cushion is achieved by adjusting the compression air rod. The disadvantages are that: it is very difficult to adjust the cushion seat by using the compression air rod to the most suitable height that is needed when a human body sits uprightly. If the seat cushion is adjusted to be slightly low, the buttocks are subject to greater pressure, and it is quite uncomfortable to sit uprightly for a long time; and if the seat cushion is adjusted to be slightly high, the legs are subject to greater pressure, resulting in difficulty in blood circulation of the legs, and it would affect human body health to sit uprightly for a long time.

SUMMARY

With regard to the foregoing technical disadvantages, the present application provides a chair capable of swinging forward and backward.

To resolve the foregoing technical problem, the technical solution of the present application is as follows:

A chair capable of swinging forward and backward includes a chair leg, a seat cushion, and a compression air rod that connects the chair leg and the seat cushion, where a bottom of the compression air rod is provided with a tapered sleeve, the tapered sleeve is disposed inside a cavity of the chair leg, an outer side of the tapered sleeve is enclosed by a soft sleeve, and the compression air rod swings by means of an interaction between the soft sleeve and a cavity wall of the chair leg.

Further, the soft sleeve is a soft ring, the soft ring includes a soft inner wall and a soft outer wall, the soft inner wall and the soft outer wall are combined to make a section of the soft ring to present an n shape, and the soft outer wall is fixed to the cavity wall of the chair leg.

Further, a lower end of the soft outer wall is provided with a fixing sheet, and the fixing sheet is fixed to the cavity wall of the chair leg.

Further, the fixing sheet is fixed to the cavity wall of the chair leg by using an adjustable screw bolt.

Further, the soft ring is a rubber ring, and a rubber inner wall and the tapered sleeve as well as a rubber outer wall and the fixing sheet are integrally formed in an injection molding manner.

Further, the chair leg includes a plastic foot, a height of a fixing point of an adjustable screw bolt of a rear-end fixing sheet of the plastic foot of the cavity of the chair leg from the ground is higher than a height of a fixing point of an adjustable screw bolt of a front-end fixing sheet from the ground, so as to set the compression air rod to incline forward by a preset angle.

Beneficial effects of the present application are that: a soft sleeve is disposed between a tapered sleeve at a bottom of a compression air rod and a cavity of a chair leg, the soft sleeve is constituted by a soft outer wall and a soft inner wall, and upper parts of the soft outer wall and soft inner wall are connected to each other to make a section of the soft sleeve to present an n shape. The compression air rod can actuate a seat cushion to rotate obliquely by 360 degrees, a height of the seat cushion is finely adjusted by leaning the seat cushion forward or backward or swinging it leftward or rightward, so that it would be easy for a person who sits uprightly to find a suitable seat cushion height, and an angle of the compression air rod can be changed at any time to change pressure on the buttocks and legs, so as to make the person who sits uprightly feel more comfortable.

DETAILED DESCRIPTION

Figure 1:
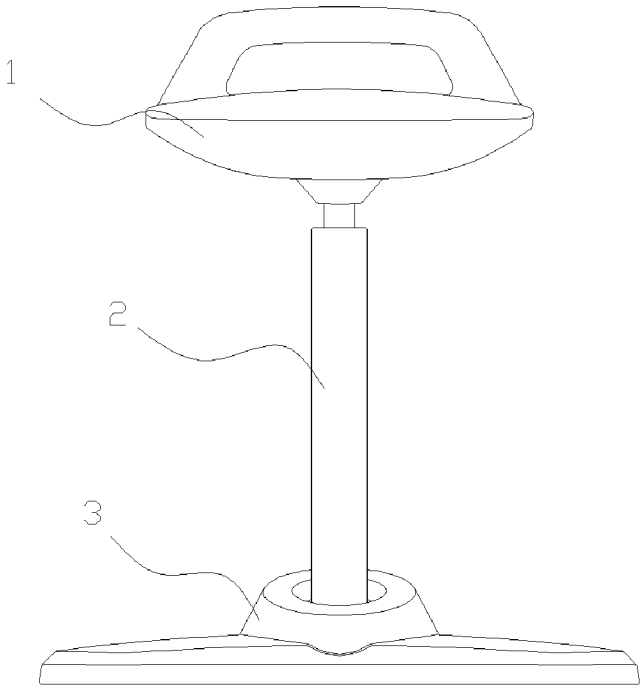
FIG. 1 is a schematic structural diagram of the present application.
Figure 2:
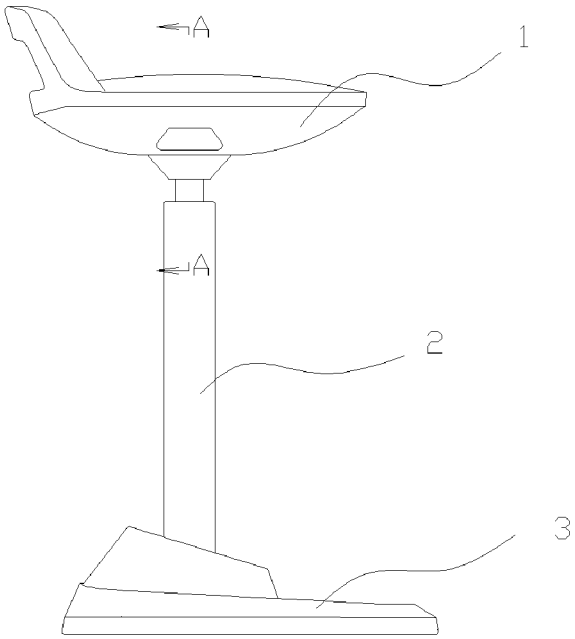
FIG. 2 is a left view of the the present application.
Figure 3:
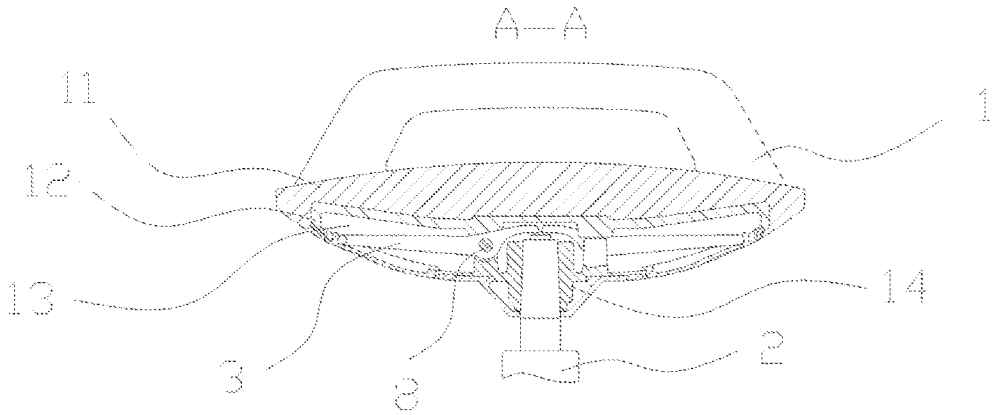
FIG. 3 is an A-A sectional diagram of FIG. 2.
Figure 4:
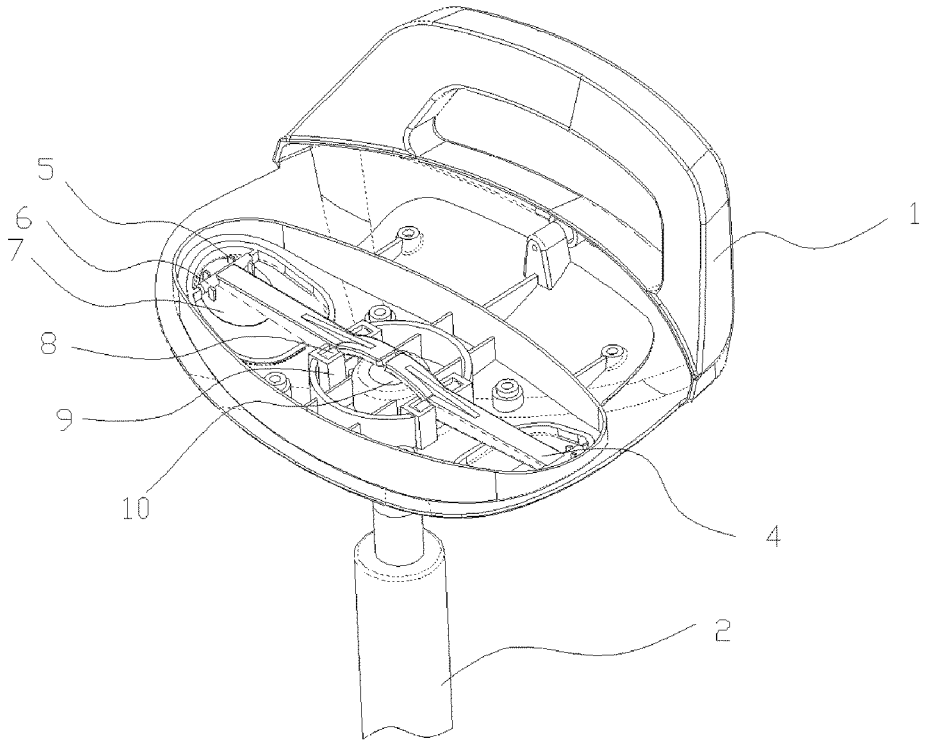
FIG. 4 is an internal anatomical diagram of the present application.

The present application is further described below with reference to the accompanying drawings and specific embodiments.

Embodiment 1

As shown in FIG. 1 to FIG. 4, a chair with a bi-directional controllable air rod valve includes a chair leg 3, a seat cushion 1, and a compression air rod 2 that connects the chair leg 3 and the seat cushion 1; and the seat cushion 1 includes a plastic cushion 12 and a soft cushion 11 disposed on the plastic cushion 12, the compression air rod 2 is provided with a support 14, the plastic cushion 12 and the support 14 cooperate with each other to form a seat cushion cavity 13 that can accommodate valve control members, and two sides of the seat cushion cavity 13 are each provided with a set of valve control members, so as to enable a user to adjust the chair with the left and right hands conveniently.

The valve control members include a swing arm 4, an end of the swing arm 4 is lapped on a valve 10 of the compression air rod 2, and the other end of the swing arm 4 is provided with a toggle sheet 7; the toggle sheet 7 is provided with four bumping posts 5, the bumping posts 5 are distributed in a trapezoidal shape, the swing arm 4 is provided with a horizontal post 6 on the end of the toggle sheet, so as to enable the swing arm 4, on the whole, to present a T shape; a lower side of the bumping post 5 is provided with an arc shape for clamping the horizontal post 6, the horizontal post 6 and the bumping post 5 are movable to each other, so that the toggle sheet 7 is mounted on the swing arm 4 and the toggle sheet 7 and the swing arm are movable to each other, between the swing arm 4 and the support 14, a pin shaft 8 is used as as a supporting point for the swing arm 4 to swing, meanwhile, a recess 9 for accommodating the pin shaft 8 is disposed on the support 14, the plastic cushion 12 covers the recess 9, so as to limit the pin shaft 8, the toggle sheet 7 may control the valve 10 of the compression air rod by swinging the swing arm 4, and because a distance from the end, where the horizontal post 6 is the located, of the swing arm 4 to the pin shaft 8 is greater than a distance between the swing arm and the valve 10, the toggle sheet 7 can easily adjust the compression air rod 2 based on the lever principle.

To achieve convenient machining and manufacturing, the horizontal post 6, the swing arm 4, and the pin shaft 8 are manufactured by design in an integrally formed manner, and the bumping posts 5 and the toggle sheet 7 are manufactured by design in an integrally formed manner.

Embodiment 2

As shown in FIG. 5 to FIG. 11, a chair capable of swinging forward and backward is provided. To swing the chair, a lower end of the compression air rod 2 is provided with a tapered sleeve 15, the tapered sleeve 15 is disposed in a cavity of the chair leg 3, the tapered sleeve 15 is enclosed by a rubber ring 14, the rubber ring 14 includes a rubber inner wall and a rubber outer wall, a height of the rubber outer wall is slightly lower than a height of the rubber inner wall, the rubber inner wall and the rubber outer wall are combined to make a section of the rubber ring 14 present an n shape, a lower end of the rubber outer wall is provided with a metal sheet 18, and the metal sheet 18 is fixed to a plastic foot of the cavity of the chair leg 3 by using an adjustable screw bolt 17. The rubber inner wall and the tapered sleeve 15 as well as the rubber outer wall and the metal sheet 18 may be integrally formed in an injection molding manner.

Figure 5:
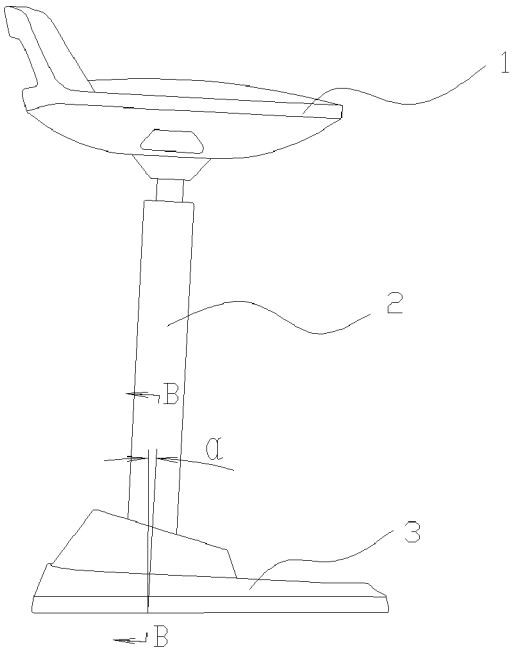
FIG. 5 is a schematic structural diagram when the present application inclines forward.
Figure 6:
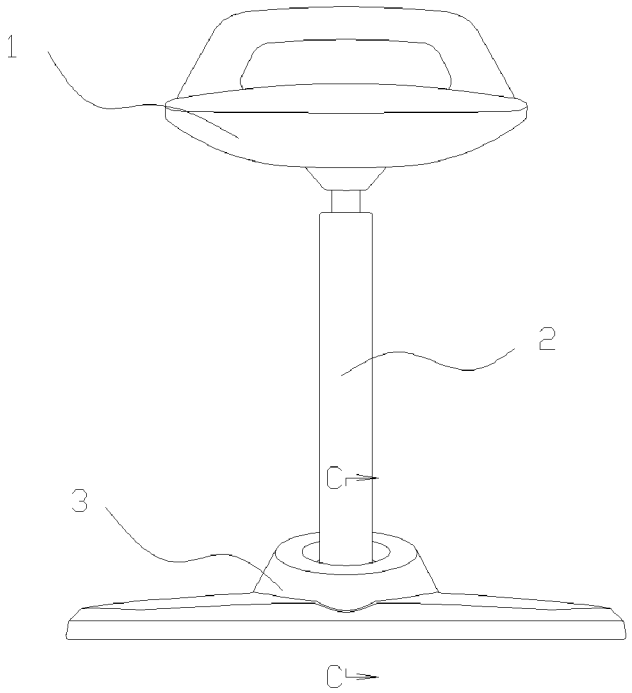
FIG. 6 is a schematic structural diagram of the present application.
Figure 7:
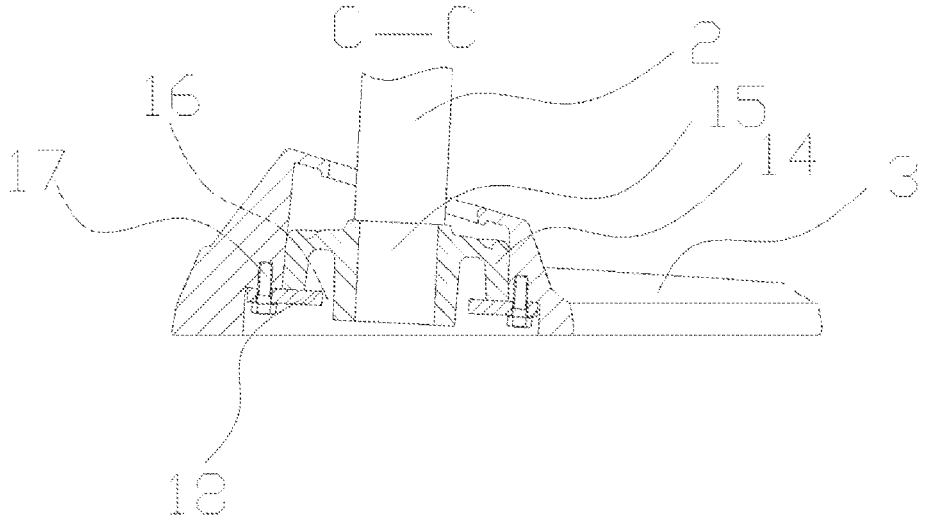
FIG. 7 is a C-C sectional diagram of FIG. 6.
Figure 8:
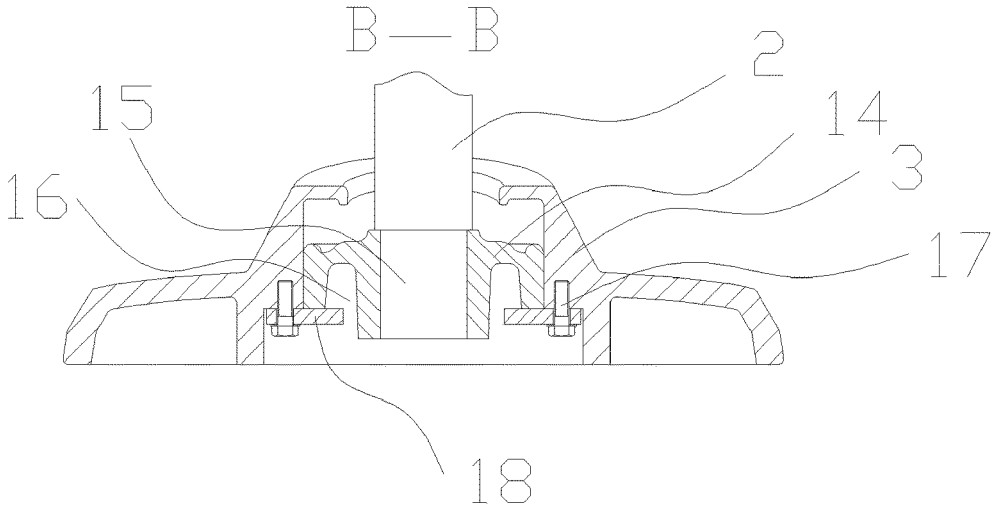
FIG. 8 is a B-B sectional diagram of FIG. 5.
Figure 9:
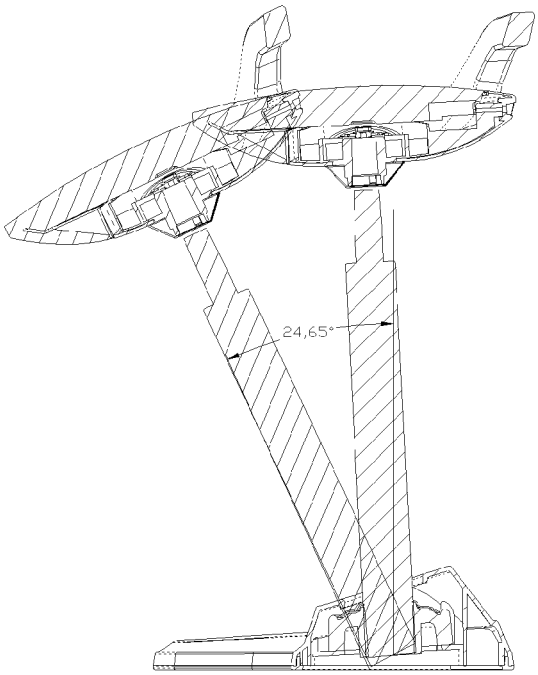
FIG. 9 is a schematic diagram of the present application that inclines forward.
Figure 10:
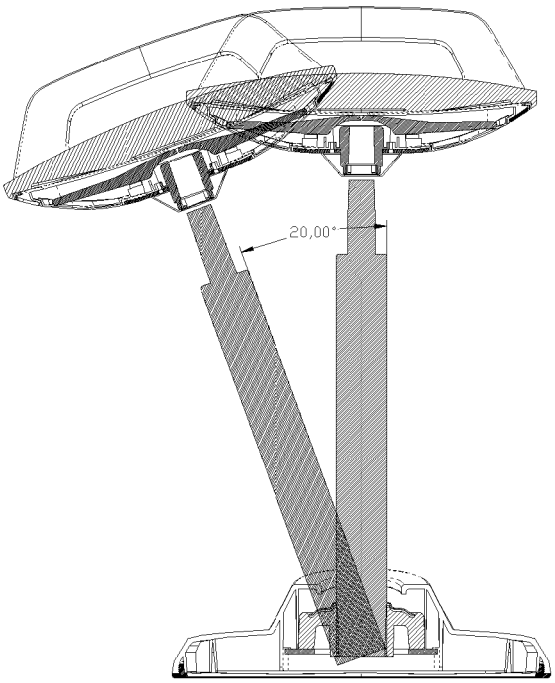
FIG. 10 is a schematic diagram of the present application that inclines leftward and rightward.
Figure 11:
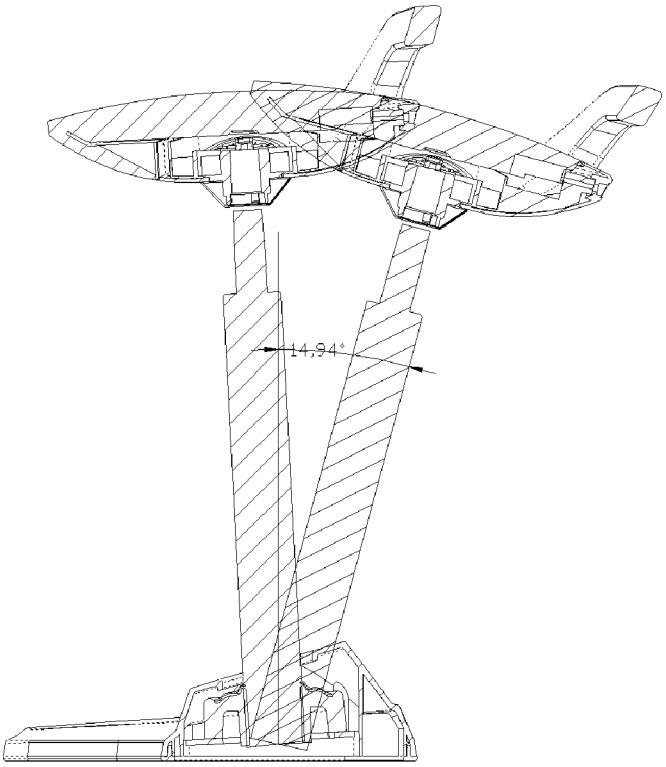
FIG. 11 is a schematic diagram of the present application that inclines backward.

Because a gap 16 exists between the rubber inner wall and the rubber outer wall, the tapered sleeve 15 at a bottom of the compression air rod 2 may incline and swing inside the gap 16, and a swinging range of the tapered sleeve 15 at the lower end of the compression air rod 2 may be further limited by using the metal sheet 18. When the metal sheet is elongated, the gap between the rubber inner wall and the metal sheet 18 is reduced, a moving range of the compression air rod 2 is accordingly limited, and when the metal sheet is shortened, the gap between rubber inner wall and the metal sheet 18 is increased, the moving range of the compression air rod 2 is accordingly enlarged. Further, preferably, as shown in FIG. 5 and FIG. 7, a height of a fixing point of a screw bolt 17 of a rear-end metal sheet 18 of the plastic foot of the chair leg 3 from the ground is higher than a height of a fixing point of a screw bolt 17 of a front-end metal sheet 18 from the ground, so as to set the compression air rod 2 to incline forward by an angle of a. By means of experiments, an adjustment range of a forward inclination angle is kept from 0 to 25 degrees, an adjustment range of a backward inclination angle is kept from 0 to 15 degrees, and an adjustment range of a leftward/rightward inclination angle is kept from −20 to 20 degrees.

The above descriptions are merely preferred embodiments of the present application, and it should be noted that several improvements and modifications can be made by those of ordinary skill in the art without departing from the concept of the present application, and the improvements and modifications may also be considered to fall within the protection scope of the present application.

What is claimed is:

1. A chair capable of swinging forward and backward, comprising a chair leg, a seat cushion, and a compression air rod that connects the chair leg and the seat cushion, wherein a bottom of the compression air rod is provided with a tapered sleeve, the tapered sleeve is disposed inside a cavity of the chair leg, an outer side of the tapered sleeve is enclosed by a soft sleeve;

wherein the soft sleeve is a soft ring, the soft ring comprises a soft inner wall and a soft outer wall, the soft inner wall and the soft outer wall are combined to make a section of the soft ring to present an n shape, and a gap is provided between the soft inner wall and the soft outer wall;

a lower end of the soft outer wall is provided with a set of fixing sheets, and the set of fixing sheets is fixed to a cavity wall of the chair leg; and the tapered sleeve is swingable in the gap, and a swinging range of the tapered sleeve is limited by using the set of fixing sheets.

2. The chair capable of swinging forward and backward according to claim 1, wherein each of the set of fixing sheets is fixed to the cavity wall of the chair leg by using an adjustable screw bolt.

3. The chair capable of swinging forward and backward according to claim 2, wherein the soft ring is a rubber ring, and a rubber inner wall and the tapered sleeve as well as a rubber outer wall and the set of fixing sheets are integrally formed in an injection molding manner.

4. The chair capable of swinging forward and backward according to claim 3, wherein the set of fixing sheets comprises a frond-end fixing sheet and a rear-end fixing sheet, a height of a fixing point of an adjustable screw bolt corresponding to the rear-end fixing sheet from the ground is higher than a height of a fixing point of an adjustable screw bolt corresponding to the front-end fixing sheet from the ground, so as to set the compression air rod to incline forward by a preset angle.

* * * * *